US005158025A

United States Patent [19]

Johnson

[11] Patent Number: 5,158,025

[45] Date of Patent: Oct. 27, 1992

[54] WASTE FUEL COMBUSTION SYSTEM

[76] Inventor: Theodore J. Johnson, 410 Reservation St., Hancock, Wis. 49930

[21] Appl. No.: 683,868

[22] Filed: Apr. 11, 1991

[51] Int. Cl.[5] ..... F23D 1/02

[52] U.S. Cl. ..... 110/235; 110/264; 431/158

[58] Field of Search ..... 110/235, 264, 265; 431/123, 158

[56] References Cited

U.S. PATENT DOCUMENTS

| | | | |
|---|---|---|---|
| 4,333,405 | 6/1982 | Michelfelder et al. | 110/264 |
| 4,543,890 | 10/1985 | Johnson | 110/102 |
| 4,565,137 | 1/1986 | Wright | 110/264 |
| 4,630,554 | 12/1986 | Sayler et al. | 110/264 |
| 4,989,549 | 2/1991 | Korenberg | 110/264 X |

*Primary Examiner*—Edward G. Favors
*Attorney, Agent, or Firm*—Michael, Best & Friedrich

[57] ABSTRACT

A waste fuel combustion system including a furnace having a grate for supporting waste fuel for burning, the grate including a plurality of movable members and a mechanism for reciprocating the movable members. The furnace also includes a primary gas passageway, a secondary gas passageway, and a throat through which the primary and secondary gas passageways pass in order to accelerate the flow of combustion gases. The waste fuel combustion system also includes recirculation conduits communicating between a source of exhaust gases and the primary and secondary gas passageways in order to recirculate the exhaust gases for additional combustion and degradation.

3 Claims, 2 Drawing Sheets

WASTE FUEL COMBUSTION SYSTEM

BACKGROUND OF THE INVENTION

1. Technical Field

The invention relates generally to combustion systems, and particularly to combustion systems for burning waste.

2. Related Prior Art

As the quantities of INDUSTRIAL municipal, agricultural and municipal waste products increase, and the dangers which such waste products can pose become more well-recognized, the need for an efficient and effective means for disposal of such waste products becomes greater. Often, conventional waste storage and disposal facilities, such as landfills or incinerators, cannot adequately destroy the waste products. For example, non-biodegradable materials, such as various types of plastic and tires, cannot be successfully accommodated over the long-term by conventional landfills because of the bulk and the extremely long biodegradation process of these wastes.

Similarly, conventional incinerators may not be able to effectively process some industrial, chemical or toxic wastes because of incomplete combustion which can result in the emission of toxic gases and particulates. In order to comply with various emission regulations, various exhaust filtering equipment such as flue scrubbers or the like may be required for the operation of the incinerator. Such ancillary equipment can significantly increase the cost of operation of the incinerator.

Also, many normally disposable waste products are merely difficult to handle and are difficult to burn completely, but could provide an additional source of fuel if burned efficiently. For example, agricultural and municipal wastes such as waste paper, food and trimmings could, if burned completely, provide an additional source of fuel. In light of the above-described circumstances, the need for an economical and ecologically acceptable means for disposing of such waste has been realized.

Attention is directed to U.S. Pat. No. 4,543,890 which issued to Johnson on Oct. 1, 1985, and which illustrates an example of a known wood fuel combustion system.

SUMMARY OF THE INVENTION

The invention provides a waste fuel combustion system for generating heat. The combustion system includes a furnace having a plurality of aligned and communicating combustion chambers defining a plurality of combustion zones, means for feeding waste fuel into the furnace, and means for completely combusting and degrading the waste fuel. In order to completely combust and degrade the waste fuel, the waste fuel combustion system includes a reciprocable support for the burning of the fuel, means for mixing the flow of combustion gases through the zones for more complete combustion, and means for recirculating flue gases from the waste fuel system to assure the complete degradation of any uncombusted or otherwise toxic emissions.

More particularly, the reciprocable support for the waste fuel includes a fuel grate formed by elongated rods which are supported for relative longitudinal movement relative to one another, and a mechanism for reciprocating and rotating the rods to shake off ash from the waste fuel supported thereon. The mechanism for reciprocating the rods can, in one embodiment, be adjusted to vary the rate of reciprocating movement in order to accommodate various waste fuels, depending on the rate of combustion thereof, to remove ash into an ash collection container and to expose uncombusted fuel.

The means for mixing the flow of gases through the furnace includes, in one embodiment, an air flow conduit or passage having a constricted region which causes an acceleration of the flow of air due to a venturi effect on the flow. More particularly, the furnace includes a combustion chamber, a secondary air passage surrounding the combustion chamber and communicating with the combustion chamber. The air passage has an end having a diminished cross-sectional area forming a throat through which combusted gases flow into the combustion chamber. The flow of gases accelerates as it passes through the throat, resulting in a greater degree of mixing of the gases in the combustion chamber. More complete combustion of the gases can be realized by such mixing.

The means for recirculating the flue gases of the waste fuel combustion system includes a conduit for redirecting the flow of exhaust gases from the secondary combustion chamber, or from another, similar source of exhaust gases, back into the primary combustion chamber and, alternatively, for returning the flow of exhaust gases to the secondary combustion chamber without passage through the primary combustion chamber. Depending on the type and amount of uncombusted exhaust gases, and the degree of degradation or pyrolysis of the exhaust, the exhaust can be recycled into the waste fuel combustor for additional exposure to heat and for additional combustion. Provision of the recirculating means allows operation of the combustion system in concert with existing sources of toxic or particulate-laden exhaust gases. For example, flue gases from municipal waste incinerators and oil or coal-fired boilers can be recirculated into the combustion system for additional degradation until the exhaust gases are ecologically acceptable.

The invention thus provides a combustion system which can burn waste fuels efficiently and which can "clean-up" flue gases in a cost-effective manner.

Various other features and advantages of the invention will become apparent to those skilled in the art upon review of the following detailed description, claims and drawings.

Figures 1, 2, 3:
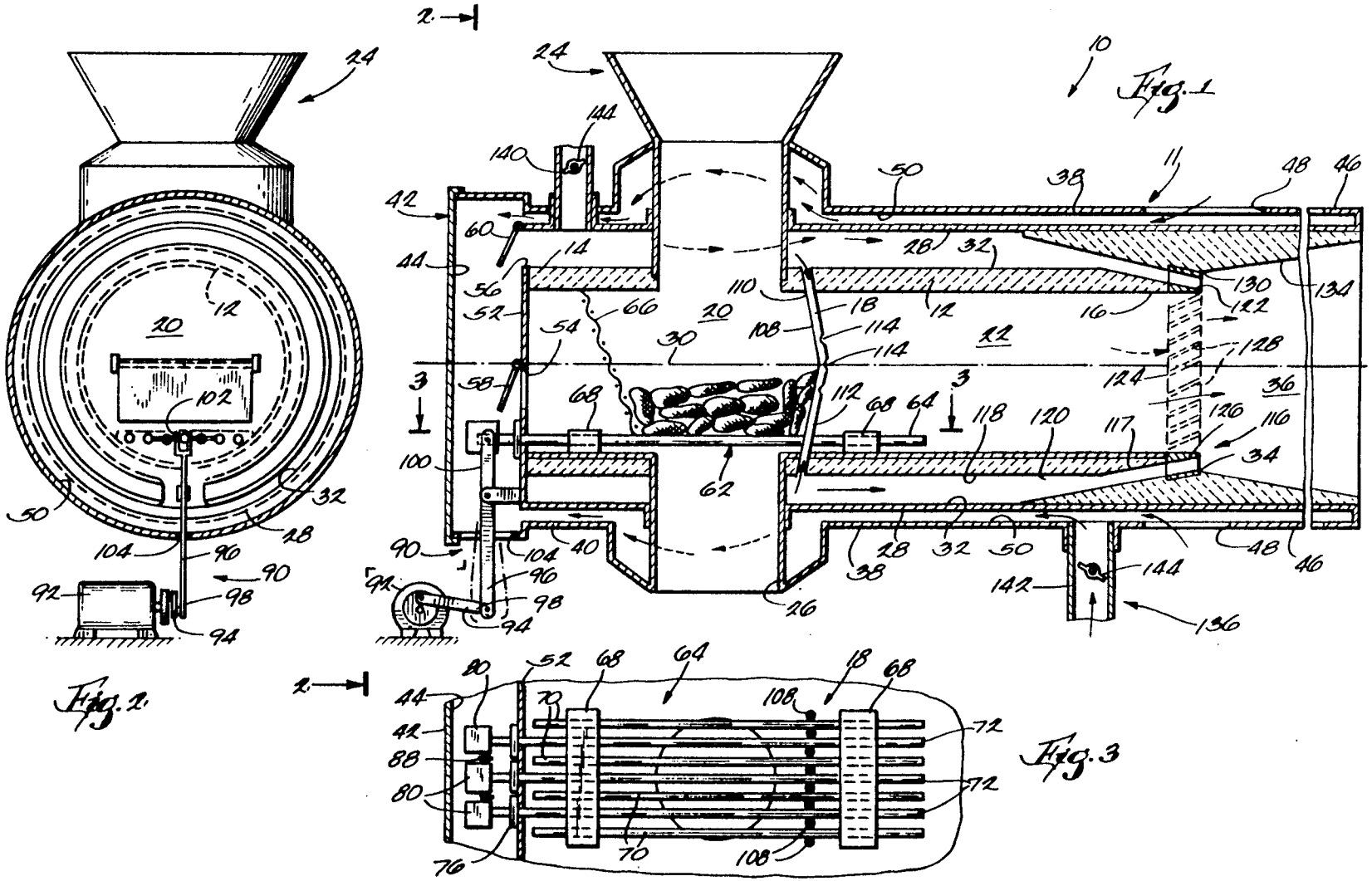
FIG. 1 is a cross-sectional view of a waste fuel combustion system embodying the invention.
FIG. 2 is a view of the system taken along line 2—2 in FIG. 1.
FIG. 3 is a view of the system taken along line 3—3 in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein are for the purpose of description and should not be regarded as limiting.

DESCRIPTION OF THE PREFERRED EMBODIMENT

The drawings illustrate a waste fuel combustion system 10 embodying the invention. The waste fuel combustion system 10 can operate as a stand-alone generator of heat or can operate in association with other, known systems to provide heat therefore. For example, the waste fuel combustion system 10 can be operated in concert with known municipal waste incinerators, oil or coal-fired boilers, or other conventional heating systems to provide energy therefore and, as discussed below, to treat exhaust gases produced thereby.

As shown in FIG. 1, the combustion system 10 comprises a furnace 11 including a first shell or elongated cylinder 12 having an inlet end 14 and an outlet end 16 and a substantially uniform inner diameter. A back grate 18, the details of which are discussed below, partitions the inner shell 12 into a first combustion chamber or zone 20 adjacent the inlet end 14 of inner shell 12 and a second combustion chamber or zone 22 adjacent the outlet end 16 of inner shell 12.

The furnace 11 also includes (FIG. 1) means in the form of a funnel assembly 24 for supplying fuel to the first combustion zone 20 of the inner shell 12, and means in the form of an ash box 26 for receiving ash from the inner shell 12. In operation, the funnel assembly 24 and the ash box 26 are closed to the atmosphere to prevent flow of air through the funnel assembly 24 and the ash box 26 into the inner shell 12.

An intermediate or second shell 28 surrounds the inner shell 12 and extends substantially the entire length of the inner shell 12. The inner and intermediate shells 12, 28 are (FIG. 2) concentrically aligned on the longitudinal axis 30 of the inner shell 12 so that the inner and intermediate shells 12, 28 are spaced and define therebetween a generally annular secondary air passage 32. As discussed more fully below, the secondary air passage 32 includes an outlet 34 which extends circumferentially around the outlet end 16 of the inner shell 12. The intermediate cylinder 28 extends beyond the outlet end 16 of the inner shell 12 and defines therein a third combustion chamber or zone 36 which communicates with the second combustion zone 22 through the outlet end 16 of the inner shell 12 and with the secondary air passage outlet 34.

The furnace 11 also includes a third or outer cylinder 38 which surrounds the inner and intermediate cylinders 12, 28 and which extends substantially the entire length of the intermediate cylinder 28 so that (FIG. 2) the intermediate and outer cylinders 28, 38 also are in generally concentric, spaced relation. The end 40 of the outer shell 38 adjacent the inlet end 14 of the inner shell 12 supports a housing 42 which defines an air cavity 44 communicable with the first combustion zone 20 and the secondary air passage 32. The opposite end 46 of the outer cylinder 38 has therethrough a plurality of openings 48 spaced circumferentially about the outer cylinder 38.

The intermediate and outer cylinders 28, 38 define therebetween an airspace or preheat air passage 50 extending the length of the intermediate and outer cylinders 28, 38. The airspace 50 (FIGS. 1 and 5) communicates between the plurality of openings 48 and the housing 42. The preheat air passage 50 can conduct a flow of gases from the openings 48 to the inlet end 14 of the inner shell 12 and is sufficiently long to heat the flow of gases passing therethrough.

An end plate 52 overlies the inlet end 14 of the inner shell 12 and separates the housing 42 and the first combustion zone 20. The end plate 52 has therein a first opening or primary inlet 54 which communicates between the air cavity 44 and the first combustion zone 20 and has therein a pair of second openings or secondary inlets 56 which communicate between the air cavity 44 and the secondary air passage 32. The end plate 52 also supports means in the form of door 58 which overlies primary inlet 54 for selectively affording communication between the air cavity 44 and the first combustion zone 20. The end plate 52 also supports means in the form of doors 60 which overlie the secondary inlets 56 for selectively affording communication between the air cavity 44 and the secondary air passage 32.

The furnace 11 operates to provide a primary flow of combustion gases from the air cavity 44 through primary inlet 54 and into the first combustion zone 20. Primary gases burn in the first combustion zone 20 and flow through the inner shell 12 through the second combustion zone 22 and into the third combustion zone 36. A secondary flow of gases passes from the air cavity 44 into openings 56, through the secondary air passage 32 and, in manner discussed below, into either the second or third combustion zones 22, 36; and a preheat flow of gases from the openings 48 in the outer cylinder 38 along the preheat air passage 50 to the air cavity 44.

The furnace 11 also includes means 62 located in the inner shell 12 for supporting waste fuel for burning. As shown in FIGS. 1 and 3, the means for supporting the waste fuel includes a generally horizontal fuel grate 64 located in the first combustion zone 20 generally below the funnel assembly 24, a screen 66 extending downwardly from the upper portion of the inner shell 12 adjacent the end plate 52 to the fuel grate 64 to prevent fuel from falling against the end plate 52, and the back grate 18 which extends vertically across the interior of the inner shell 12 between the first and second combustion zones 20, 22. As shown in FIG. 1, the screen 66 and the back grate 18 are preferably arranged to retain fuel supplied to the furnace 11 by way of the funnel on the fuel grate 64.

The fuel grate 64 comprises a frame 68 supported by the inner shell 12 inside the first combustion zone 20 and (FIG. 3) a plurality of elongated rods supported by the frame 68. A first plurality of the rods 70 is fixed to the frame 68 so that the rods 70 extend generally parallel to the axis 30. The frame 68 supports a second plurality 72 of rods so that the rods 72 are generally parallel to the first plurality of rods 70 and are preferably in alternating relation to the rods 70. The frame 68 supports the second plurality of rods 72 for longitudinal movement relative to the frame 68 and to the first plurality of rods 70 in the direction of axis 30. The frame 68 also supports the rods 72 for rotation about their respective longitudinal axes. While various constructions can be used, in the illustrated embodiment, each of the second plurality of rods 72 (FIG. 3) has a threaded end 74 which extends through the end plate 52 and which is housed by the air cavity 44. The end plate 52 supports thereon a plurality of blocks 76, each of which has therethrough an internally threaded bore 78 surrounding and engaging the threaded ends 74 of the rods 72. Due to the threaded engagement of the blocks 76 and the rods 72, longitudinal movement of the rods 72 causes rotation of the rods 72.

Figure 6:
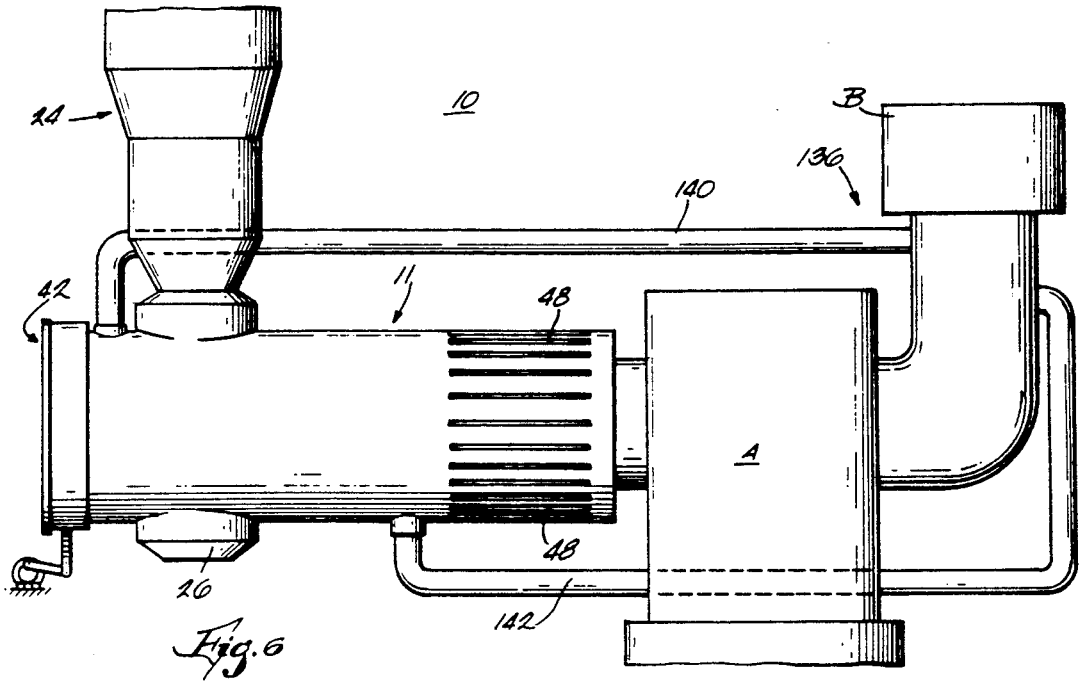
FIG. 6 is an elevational view of the waste fuel combustion system connected to a heating system.

The threaded ends 74 of the second plurality of rods 72 respectively support drive bearing assemblies 80 which drivingly engage the rods 72 for reciprocal longitudinal movement and which afford rotation of the rods 72 about their respective longitudinal axes. FIG. 6 illustrates a preferred construction for the bearing assembly 80. Each bearing assembly 80 includes a plurality of ball bearings 82 housed by a circumferencially extending groove 84 in the end 74 of the rod 72 and by a grooved bearing end cap 86 fixed on the end 74 of the rod 72. A drive pin 88 extends between the bearing caps 86 on the rods 72 so that the moveable rods 72 are connected and move longitudinally in unison.

Drive means 90 is also provided for reciprocally moving the second plurality of rods 70. The drive means 90 includes a variable speed motor 92 located under housing 42 (FIG. 1) and a drive arm 94 which is driven by the motor 92, and is operably connected to a follower arm 96. The follower arm 96 (FIGS. 1–3) has a first end 98 which is pivotally connected to the drive arm 94 and a second end 100 which is in the form of a clevis 102. Clevis 102 is drivingly connected to the bearing assemblies 80 on the ends 74 of the movable rods 72 by means of a pivotable connection with the drive pin 88.

The follower arm 96 extends generally vertically upwardly from the drive arm 94 through (FIG. 1) a slot 104 in the lower portion of the housing 42 and into the air cavity 44. A bracket 106 which is supported by the intermediate cylinder 28 and which extends into the air cavity 44 pivotally supports the follower arm 96 so that the ends 98, 100 of the follower arm 96 are reciprocally movable in the direction of axis 30. Operation of the motor 92 cause reciprocal motion of the second end 100 of the follower arm 96 (to the left and right in FIG. 1), causes pivotal movement of the arm 96, and causes reciprocating motion of the second plurality of elongated rods 72. Operation of the drive means 90 for reciprocating the rods 72 acts to shake ash from the fuel supported on the fuel grate 64 so that ash from the fuel can fall into the ash collection box 26 and so that uncombusted fuel is exposed for burning. Preferably, the drive means 90 for reciprocating the rods 72 also includes means, such as the variable speed motor 92, for varying the speed of reciprocating motion or means, such as a timer mechanism (not shown), for intermittently reciprocating the rods 72 in order to accommodate the rate of combustion of various waste fuels.

The furnace 11 includes means for affording a flow of a portion of the secondary flow of gases from the secondary air passage 32 into the second combustion zone 22. In the illustrated embodiment, the means for affording a flow of secondary gases into the second combustion includes the back grate 18 which comprises a plurality of hollow tubes 108 extending and communicating between the secondary air passage 32 and the interior of the inner shell. Preferably, the tubes 108 include an upper portion 110 and a lower portion 112 which respectively extend inwardly of the inner shell 12 and slightly axially toward the outlet end 16 of the inner shell 12. Each of the tubes 108 also has therein at least one opening 114 to provide means affording a flow of a portion of the secondary gases to enter the second combustion zone 22 from the secondary air passage 32. As secondary air flows from the secondary air passage 32 into the tubes 108, relatively high temperature primary combustion gases heat the secondary air so that secondary air introduced to the primary flow through the back grate 108 has a temperature in the same temperature range as that of the primary gases.

The provision of means affording a flow of secondary air into the second combustion zone 22 effects several desirable results. The introduction of uncombusted, heated gases into the second combustion zone 22 enhances the further combustion of primary combustion gases passing from the first combustion zone 20 into the second combustion zone 22. Also, the passage of secondary air through the tubes 108 helps cool the back grate 18 which extends the operational life of the back grate 108.

Preferably, the holes in the tubes 108 are located at various radial positions so that secondary air injected into the second combustion zone 22 spirals and mixes with the primary flow of gases. The resultant turbulence caused by the injection of secondary gases into the second combustion zone 22 also enhances combustion in the second combustion zone 22. Thus, the furnace 11 provides means for enhancing the combustion of gases in the second combustion zone 22.

The furnace 11 also includes means 116 for enhancing combustion in the third combustion zone 36 including means 117 for accelerating the secondary flow of gases from the secondary air passage 32 into the third combustion zone 36. The accelerating means 117 includes a first portion 118 of the secondary air passage 32 which has a generally uniform cross-sectional area in a plane perpendicular to axis 30, and a second portion 120 having a decreasing inner diameter so as to have a diminished cross-sectional area in a plane perpendicular to axis 30. As shown in FIG. 1, the second portion 120 of the secondary air passage 32 diminishes in cross-sectional area from a point intermediate the inlet end 14 and the outlet end 16 of the inner shell 12 to a throat 122 at the outlet 34 of the secondary air passage 32. Preferably, the cross-sectional area of the secondary air passage 32 decreases approximately one-third to one-half along the second portion 120 to the throat 122.

As the secondary flow of gases passes from the air cavity 44, along the first portion 118 of the secondary air passage 32, some of the secondary flow passes the second portion 120 of the secondary air passage 32 and through the back grate 18. The remainder of the secondary flow passes into the second portion 120 of the secondary air passage 32 and accelerates into the throat 122. The secondary gas flow exits the nozzle-like outlet 34 with increased velocity into the third combustion zone 36 due to the venturi-like effect of the reduced cross-sectional area of the throat 122. As discussed more fully below, the secondary flow of gases is directed generally radially inwardly into the third combustion zone 36 due to the radially inward direction of the second portion 120 of the secondary air passage 32.

Figure 4:
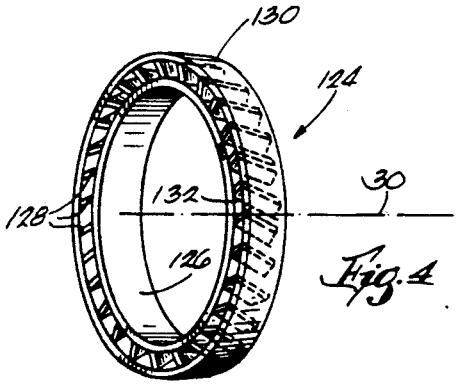
FIG. 4 is a perspective view of a portion of the system shown in FIG. 1.

The means 117 for accelerating the flow of combustion gases also includes (FIGS. 1 and 4) a stator 124 for introducing a rotational component into the flow of combustion gases. The stator 124 includes (FIG. 4) an inner ring 126 which is disposed on the exhaust end of the inner shell 12 and which defines the inlet of the third combustion zone 36. The stator 124 also includes a plurality of spaced-apart fins 128 which are disposed circumferentially around the inner ring 126 and which extend radially outwardly therefrom. The stator 124 further includes an outer ring 130 which concentrically surrounds the inner ring 126, is connected to the fins 128, and which is disposed on the interior of the intermediate cylinder 28 adjacent the outlet 34 of the secondary air passage 32.

As shown in FIG. 1, the stator 124 is located immediately downstream of the outlet end 16 of the inner shell 12 and is constructed so that the primary flow of gases flows from the inner shell 12 and through the inner ring 126 into the third combustion zone 36. The fins 128 extend across the outlet 34 of the secondary air passage 32 and across the secondary flow of gases. Each fin 128 has a surface 132 which is angled relative to axis 30 and to the direction of the secondary flow of gas exiting the secondary air passage 32. Each fin 128 deflects a portion of the secondary flow so that the stator 124 introduces a rotational component to the secondary flow as the secondary flow leaves the outlet 34 and enters the third combustion zone 36.

The stator 124 also introduces a rotational component to the primary flow of gases. Because of the generally radially inward direction of the secondary flow as the secondary flow enters the third combustion zone 36, and because the secondary flow is angled, due to the stator 124, relative to the generally axial flow path of the primary flow, the secondary flow mixes with the primary flow and causes rotation of the primary flow in the third combustion zone 36. The combination of acceleration and rotation of the primary and secondary flows of gases increases mixing and turbulence of the combustion gases in the third combustion zone 36 and enhances combustion of unburned gases in the third combustion zone 36.

Because the secondary flow passes through the stator 124, the accelerated flow from the secondary air passage 32 also provides means for cleaning the stator 124 by helping to prevent the accumulation of ash which can block the stator 124. The accelerated secondary flow tends to blow ash away from the fins 128 and thereby maintains the effectiveness of the stator 124.

The construction of the intermediate cylinder 28 also aids in the mixing in the third combustion zone 36 of the primary and secondary flows. As shown in FIG. 1, the intermediate cylinder 28 includes a portion 134 which is located adjacent the outlet end 16 of the inner shell 12 and which, adjacent the outlet end 16, has an inner diameter substantially equal to the diameter of the outer ring 130 of the stator 124. The interior cross-sectional area of the portion 134 of the intermediate cylinder 28 increases along the length of the intermediate cylinder 28 so that the interior cross-sectional area of the portion 134 when viewed in a plane generally perpendicular to axis 30 also increases. The provision of an increasing cross-sectional area of the third combustion zone 36 adjacent the outlet end 16 of the inner shell 12 promotes turbulence and mixing of the flow of combustion gases by acting as a diffuser. The accelerated gases passing through the throat 122 decrease in velocity because of the increasing cross-sectional area of the third combustion zone and become more turbulent.

Figure 5:
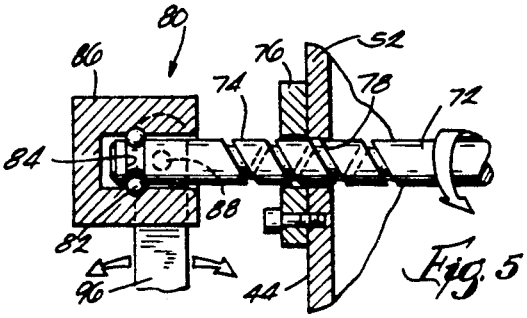
FIG. 5 is an enlarged view of a portion of the system shown in FIG. 3.

The waste fuel combustion system 10 also includes (FIG. 5) recirculating means 136 for returning exhaust or flue gases from the third combustion zone 36 or from other associated sources of exhaust gases to the furnace 11 for further combustion or degradation. More particularly, and as shown in FIGS. 1 and 5, the recirculating means 136 includes means for selectively conducting exhaust gases to the inlet 14 of the inner shell 12 and for selectively conducting exhaust gases to the second and third combustion zones without passing through the first combustion zone 20. The recirculating means 136 includes a first conduit 140 which communicates with (FIG. 5) a source of exhaust gases, such as the exhaust of the third combustion zone 36, the exhaust of a boiler or heating system A operated in conjunction with the waste fuel combustion system 10, or any other source of toxic or uncombusted gases. For example, the first conduit 140 could communicate with a conventional exhaust stack, such as exhaust stack B illustrated in FIG. 6 or the exhaust stack illustrated in the aforementioned U.S. Pat. No. 4,543,890. The first conduit 140 also communicates, as shown in FIG. 1, with the first portion 118 of the secondary air passage 32 adjacent the air cavity 44. Exhaust gases from the source of exhaust gases can flow from the source, through the first conduit 140, and into the secondary air passage 32. Gases from the first conduit 140 are thereby introduced to the secondary flow of gases and pass into the second and third combustion zones 22, 36 without passing through the first combustion zone 20.

The recirculating means 136 also includes a second conduit 142 which communicates between the source of exhaust gases and the preheat air passage 50 in a manner similar to the first conduit 140. Exhaust gases can flow through the second conduit 142 between the source of exhaust gases to the air cavity 44 through the preheat air passage 50. By controlling the flow of gases from the cavity into the secondary air passage 32 or into the first combustion zone 20 by the doors 58, 60 the recirculated exhaust gases can be directed into the first combustion zone 20 through inlet 54 or into the secondary air passage 32 through inlet 56.

Means are also provided for selectively and adjustably regulating the flow of gases through the first and second recirculating conduits 140, 142. As shown in FIG. 1, each of the first and second conduits 140, 142 house a valve 144 which is selectively operable to control the flow of gas therethrough. Preferably, the valves 144 are in the form of a butterfly valve.

Depending on the type of exhaust gases produced by the source, additional combustion or degradation thereof maybe required. Because the first and second conduits 140, 142 lead to different passageways, i.e. the preheat air passage 50 and the secondary air passage 32, the recirculated exhaust gases can be subjected to various additional amounts of heat for various periods of time. For example, if combustion of the recirculated exhaust gases requires exposure to relatively intense heat for a relatively short duration, the exhaust gases can be recirculated through the first conduit 140 so that the exhaust gases are recirculated directly into the second and third combustion zones 22, 36. As a second example, if further degradation or combustion of the exhaust gases requires exposure of the gases to lower levels of heat for a longer duration, the exhaust gases can be recirculated through the second conduit 142 and through the preheat air passageway 50 into the air cavity 44. Once in the air cavity 44, the recirculated gases can be mixed with either of the primary flow or secondary flow by adjusting the position of doors 58 and 60.

Various other features of the invention are set for in the following claims.

I claim:

1. A furnace for burning waste fuel, the furnace comprising a first wall defining a first elongated cylinder having an inlet end, an outlet end spaced from the inlet end, an axis extending between the inlet end and outlet end, and a substantially uniform outer diameter, and the cylinder defining therein a combustion chamber, a second wall defining a second cylinder surrounding the first cylinder and spaced from the first cylinder, the first and second cylinders defining therebetween an air passage communicable with the outlet end of the first cylinder, the air passage including a first portion having a relatively uniform cross-sectional area in a plane extending generally perpendicular to the axis and including a second portion located between the first portion and the outlet end, the air passage being adapted for conducting a secondary flow of gases from the inlet end to the outlet end, and means for accelerating the flow of gases through the air passage as the flow approaches the outlet end of the air passage, the means for accelerating the flow of combustion gases including means for decreasing the cross-sectional area of the second portion of the air passage in a plane generally perpendicular to the axis and adjacent the outlet end of the first cylinder, wherein the second elongated cylinder concentrically surrounds the first elongated cylinder and defines another combustion chamber communicating with the first combustion chamber, wherein the means for accelerating the flow of gases includes means for introducing the flow of gases to the other combustion chamber at an angle relative to the direction of the longitudinal axis of the combustion chamber, wherein the secondary passage extends generally parallel to the axis and surrounds the first cylinder, wherein the means for accelerating the flow of gases includes means for introducing a rotational component to the flow, wherein the means for introducing a rotational component to the flow includes a stator having a plurality of fins which extend across the flow, and wherein each of the fins includes a surface which is angled with respect to the direction of the secondary passage, wherein the stator is located intermediate the first combustion chamber and the other combustion chamber, and including means for cleaning the stator.

2. A furnace for burning waste fuel, the furnace comprising a first wall defining a first elongated cylinder having an inlet end, an outlet end spaced from the inlet end, an axis extending between the inlet end and outlet end, and a substantially uniform outer diameter, and the cylinder defining therein a combustion chamber, a second wall defining a second cylinder surrounding the first cylinder and spaced from the first cylinder, the first and second cylinders defining therebetween an air passage communicable with the outlet end of the inner shell, the air passage including a first portion having a relatively uniform cross-sectional area in a plane extending generally perpendicular to the axis and including a second portion located between the first portion and the outlet end, the air passage being adapted for conducting a secondary flow of gases from the inlet end to the outlet end, and means for accelerating the flow of gases through the air passage as the flow approaches the outlet end of the air passage, the means for accelerating the flow of combustion gases including means for decreasing the cross-sectional area of the second portion of the air passage in a plane generally perpendicular to the axis and adjacent the outlet end of the first cylinder, wherein the second wall also defines another combustion chamber which communicates with the first combustion chamber and with the second portion of the secondary passage and including a third cylinder surrounding the first cylinder and the second cylinder and being spaced from the second cylinder to define therebetween a second air passage.

3. A furnace as set forth in claim 2 wherein the first and second passages are communicable with the first combustion chamber.

* * * * *